United States Patent [19]

Eickmann

[11] Patent Number: 4,626,177

[45] Date of Patent: Dec. 2, 1986

[54] HYDRAULIC ARRANGEMENT

[76] Inventor: Karl Eickmann, 2420 Isshiki, Hayama-machi, Kanagawa-ken, Japan

[21] Appl. No.: 677,774

[22] Filed: Dec. 3, 1984

Related U.S. Application Data

[62] Division of Ser. No. 429,746, Sep. 30, 1982, abandoned, which is a division of Ser. No. 179,420, Aug. 19, 1980, Pat. No. 4,475,870.

[51] Int. Cl.[4] ..... F04B 17/00; F04B 35/00

[52] U.S. Cl. ..... 417/271

[58] Field of Search ..... 417/271, 273, 225; 91/491

[56] References Cited

U.S. PATENT DOCUMENTS

| | | | |
|---|---|---|---|
| 2,394,285 | 2/1946 | Bevins | 417/273 |
| 2,485,753 | 10/1949 | Lefler | 417/225 |
| 2,762,307 | 9/1956 | Orloff | 417/271 |
| 2,845,030 | 7/1958 | LeFobure et al. | 417/271 |
| 2,941,475 | 6/1960 | Blair | 417/238 |
| 3,133,503 | 5/1964 | Sheler | 417/271 |
| 3,614,267 | 10/1971 | Schultz | 417/273 |
| 3,874,271 | 4/1975 | Eickmann | 91/491 |
| 4,072,445 | 2/1978 | Hay | 417/405 |

FOREIGN PATENT DOCUMENTS

| | | | |
|---|---|---|---|
| 589489 | 12/1959 | Canada | 417/273 |
| 961341 | 5/1950 | France | 417/273 |
| 1216763 | 12/1970 | United Kingdom | 417/273 |
| 1302163 | 1/1973 | United Kingdom | 417/273 |

*Primary Examiner*—William L. Freeh

[57] ABSTRACT

A hydraulic arrangement has a housing which includes a first space of a definite first pressure and a second space with a lower second pressure. A primary pump supplies fluid under the first pressure into the first space to open the entrance ports into cylinders, which contain pistons therein, whereby the pistons are forced partially out of the cylinders and into the mentioned second space. In the second space the pistons are moved inwardly into the cylinders by an eccentric cam ring to supply a flow of fluid of a fourth pressure out of the outlet of the arrangement's housing. In modified embodiments the arrangement is a pressure transmission, which takes in a third pressure to drive a motor in the arrangement which in turn drives the shaft with the eccentric cam and the unit then exits the fourth pressure, which might be a very high pressure of up to more than ten thousand pounds per square inch. Still other embodiments show in several modifications a device to reciprocate or oscillate exterior linear or rotary motors either permanently or stepwise in predetermined cycles. Working actions of machines or vehicles can so be driven and controlled by the arrangement without additional control facilities, when so desired.

1 Claim, 4 Drawing Figures

HYDRAULIC ARRANGEMENT

REFERENCE TO RELATED APPLICATIONS

This is a divisional patent application of my application Ser. No. 429,746 which was filed on Sept. 30, 1982 as a divisional application of my still earlier application Ser. No. 179,420 which was filed on Aug. 19, 1980 and which issued as U.S. Pat. No. 4,475,870 on Oct. 9, 1984. Application Ser. No. 429,746 is now abandoned.

BACKGROUND OF THE INVENTION

1. Field of the Invention

This invention relates to hydraulic arrangements as pumps, motors or transmissions and may even include some control devices. The invention uses a novel arrangement to obtain novel effects, like a pressure transmission, a very high pressure fourth pressure stage exceeding, if desired, ten thousand pounds per square inch, automatic reciprocation, vibration, step advances or rotary steps of exterior linear or rotary hydraulic motors or others. Partially known elements of the former art or of my earlier patents may be included in the novel arrangement is so desired or if of special value.

2. Description of the Prior Art

At this present time of filing this application there is no former art of the main aims of the invention known to the applicant. Also there are no arrangements known presently to the applicant which would correspond to the arrangement of the invention.

However, as applicant sees it, there are a great number of efficient hydraulic pumps, motors and transmissions available, which as pumps supply one or more flows of fluid, as motors are driven by a fluid flow from a hydraulic pump and as transmissions combine a pump and motor in a single unit.

Some of them are my own elder patents and they are very effective and powerful. For example; my following elder U.S. Pat. Nos.: 2,975,716; 3,158,103; 3,223,046; 3,277,834; 3,398,698; 3,831,496; 3,850,201; 3,889,577; 3,960,060; 3,951,047; 4,212,230; 3,874,271 and others.

As far as motors or first pumps are used in the arrangement of the invention, these patents might be utilized in part in the invention or some of these patents may also be used entirely in a portion of the arrangement of the present invention. The last mentioned patent already uses the cam of the second space of this invention, however the piston shoes and piston of this elder patent fail to reach the high efficiency and pressure of this present invention. Moreover the mentioned patent partially failed because it did not take efficiently care of the required first and second spaces of the invention with the therein required first and second pressures.

3. Limitations of the Prior Art

The usual pump of the former art delivers a flow of fluid of permanent rate of flow. The control of the directional changes of pistons in external cylinders is commonly done by control valves. Plural flow pumps with equal rates of flow in different flows can do directional changes of external pistons, when they are equally variable, but the directional controls are then usually not very fast and not exactly volumetrically determined. Thus, they are not very good in vibrating or oscillating external pistons rapidly at high frequencies.

When hydraulic motors would drive highest pressure pumps to create a highest fourth pressure flow, they would require clutches between motor and pump and fastening housings to connect them. Their weight would exceed several times the weight of the arrangement of the invention, when present market pumps and motors would be used.

The pump of my U.S. Pat. No. 3,874,271 failed to set a disloading passage to the space, wherein the eccentric cam revolved or wherein the outer piston shoes moved. That resulted therein, that after a short time of operation the leakages which escaped through the fitting clearance between the outer face of the piston and the inner face of the cylinder, the space wherein the cam or the piston shoes moved, filled up with a higher pressure and finally the pressure in this respective space became equal to the pressure of the pressure in the high-pressure cylinder or at least it exceeded the pressure which was supplied by the supercharger pump. The consequence thereof is, that the piston could not move any more under the pressure supplied from the first pump or from the supercharger pump. The piston just remained finally in a stationary position and the high pressure pump became unable to deliver any pressure fluid, because the piston did not, or only little, reciprocate.

The pump of U.S. Pat. No. 3,874,271 also failed to give enough long piston shoe stroke and piston stroke and also failed to operate at the sometimes required very high fourth pressure of the invention, because it had not long enough piston shoe extensions and not long enough or no recessportions which extended beyond the outer end or innermost end of the cylinder deeper into the respective cylinder block. The piston shoes of this patent also failed to divide the balancing pockets into plural pockets with bearing lands or faces therebetween and thereby they failed to stand at very high pressures without increasing friction.

SUMMARY OF THE INVENTION

The invention attempts to either partially or totally to overcome or reduce the limitations and errors of the former art. In addition the invention aims to provide new hydraulic arrangements for novel operations or to do a novel work or novel works.

The invention also attempts to increase the powers and efficiencies of hydraulic arrangements.

The invention gives in a number of embodiments of the invention a number of solutions for the aims of the invention. These are described and illustrated in great detail in the description of the preferred embodiments and in the figures of the drawings.

A hydraulic arrangement includes a pump with a plurality of pumping chamber groups with plural individual pumping chambers in each of the chamber group. The chambers of the chamber groups are communicated to individual outlets per chamber group. The individual outlets of the chamber groups are communicated to different places of inlets to a valve arrangement. The valve arrangements acts between the forces of fluid on one axial end of the valve and the forces of a spring on the other axial end of the valve body to move the valve body along its axis in a valve housing portion for communication of different inlets to the delivery port of the valve and other inlets to a low pressure space in order to let the individual chamber groups of the pump act for delivery of flow of fluid at different pressure ranges. The arrangement thereby provides a stepwise change of the delivery quantity of the arrangement at different pressure ranges. The speciality of the arrangement is that the pressure ranges at which the valve body acts and controls the number of chamber groups and thereby the quantity of flow is for very high pressures which exceed three thousand pounds per square inch.

For low pressure ranges such arrangements are known from, for example, U.S. Pat. No. 2,074,618. At such low pressure arrangements the valves, however, tend to weld on the walls of the valve housing because the pressure in fluid presses the valve body laterally against a portion of the wall wherein the valve body should reciprocate.

It is therefore an object of this invention to overcome the problems of the known arrangements and to provide a stepwise control for the communication of individual working chamber groups of a high pressure pump to the delivery port of the arrangement at different high pressure ranges of pressures which exceed three thousand pounds per square inch.

Other objects of the invention include arrangements to seal first spaces from second spaces to secure the travel of pistons in cylinders and arrangements to oscilate motors in dependence on a rotation of a shaft in a pump. As far as those other objects of the invention are not fully described in the present application, they are fully discussed in a co-pending patent application or applications.

DESCRIPTION OF THE PREFERRED EMBODIMENTS

In the Figures of the specification referential numbers 1 indicate the first space; 2 the second space, 3 the third space and 4 the fourth space. The referentials 5 indicate the cylinders, 6 the pistons, 7 the piston shoes, 9 the shaft; 10 the first eccentric cam ring, 11 the second eccentric cam ring, 12 the outer face of the respective eccentric cam ring, 13 and 14 the eccentric axes of the respective cam ring, 15 the axis of the shaft 9, 16 the cylinder block(s), 17 the entrance port, 18 the exit port, 19 the housing, 20 the inlet and 21 the outlet.

Figure 1:
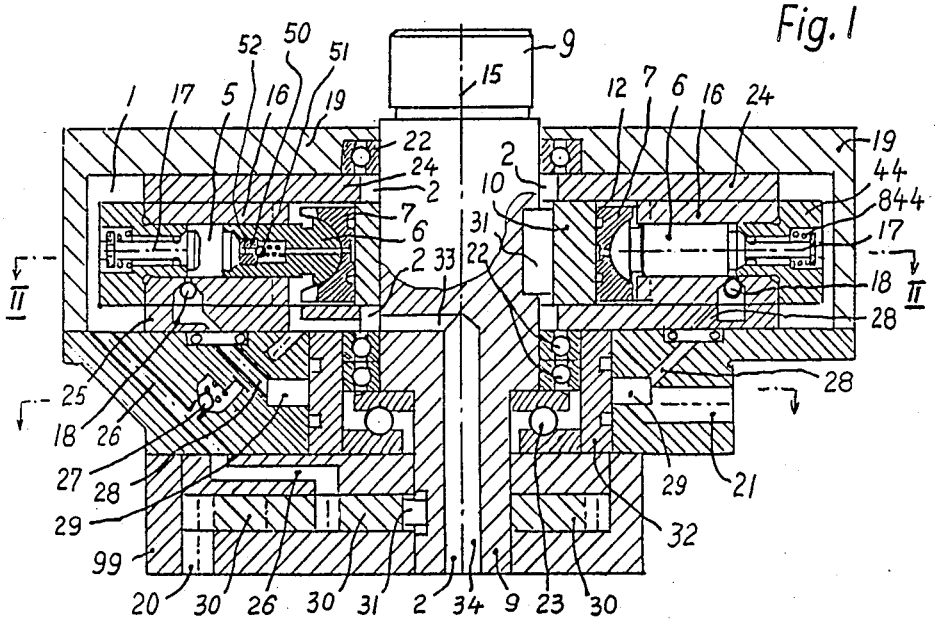
FIG. 1 is a longitudinal view through one embodiment of the invention.
Figure 2:
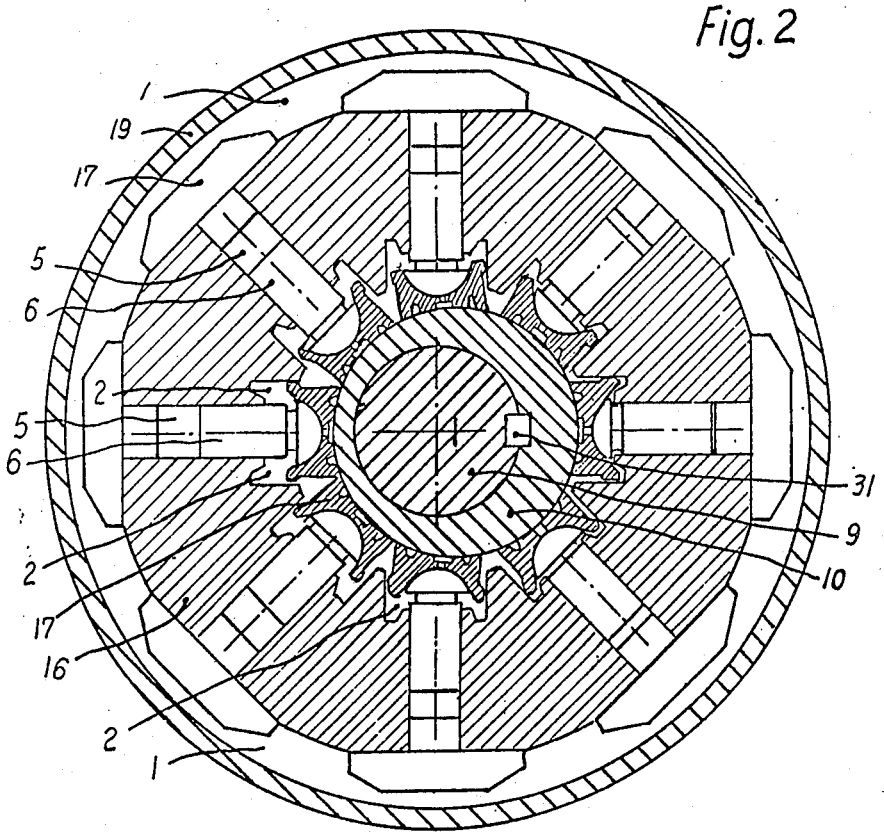
FIG. 2 is a cross-sectional view through FIG. 1 along the line II—II.

The embodiments work basically as follows:

An hydraulic arrangement includes in combination, a housing 19, a rotary shaft 9 revolvably borne in the housing 19, at least eccentric cam ring 10 and/or 11 revolving in unision with shaft 9 when the shaft 9 revolves, the mentioned cam ring 10, 11 is surrounding a portion of the shaft 9 and is forming a cylindrical outer face 12 of equal radii around an axis 13, 14 which is parallel to the axis 15 of shaft 9 but distanced therefrom by a first eccentricity or a second eccentricity; at least one cylinder 5 in at least one cylinder block 16 is provided in the mentioned housing 19 whereby the cylinder block 16 is containing at least one cylinder, at least one piston 6, at least partially connecting to at least one entrance port 17, and at least one exit port 18 to pass fluid into and out of the mentioned at least one cylinder 5 when the mentioned at least one piston 6 reciprocates in the at least one cylinder 5. The housing 19 has in its interior at least one first space 1 and at least one second space 2 and is provided with at least one inlet 20 and at least one output 21. The first space 1 is sealed and separated from the second space 2. The first space 1 engages the mentioned at least one entrance port 17 and the mentioned outlet 21 communicates to the at least one exit port 18. The mentioned second space 2 surrounds the at least one cam ring 10, 11. The mentioned at least one piston 6 is capable of entering at least partially into the mentioned second space 2 and it is engaging at least indirectly the mentioned outer face 12 of the respective cam ring 10, 11. The outer face 12 of the respective cam ring 10, 11 is thereby at least indirectly engaging to guide at least partially the stroke or reciprocation of the mentioned at least one piston 6 when the shaft 9 revolves and the piston 6 reciprocates in cylinder 5. When the piston 6 is not directly engaging the outer face 12 of the cam ring 10 or 11, at least one piston shoe 7 is inserted between the piston 6 and the outer face 12 of cam ring 10 or 11. Referring now first to FIGS. 1 and 2, the housing 19 carries bearings 22 wherein the shaft 9 is revolvably borne. Thrust bearing 23 bears the end of shaft 9. The first space 1 is located around the cylinder block 16 and filled with fluid of a first pressure by first pump 30, which may also be driven by shaft 9. Inlet 20 leads the fluid to pump 30, which is drawn here as a gear pump but which might in this as well as in others of the figures also be any suitable other pump, for example, internal gear pump, vane pump or fixed or variable piston pump. Key 31 connects the first gear 30 of the pump 30 to shaft 9. First pump 30 delivers the first pressure through passage 26 into the first space 1. The height of pressure in first space 1 may be set by relief valve or pressure limitation valve 27 which communicates with passage 26 and the second space 2, whereby excessive fluid supply from pump 30 flows over valve 27 into the low pressure—or second space 2.

The eccentric cam ring 10 is fastened by key 31 to shaft 9. The outer face 12 of cam ring 9 has equal radii around the eccentric axis 10 which is radially displaced from axis 13 of shaft 9 but parallel thereto.

During operation of the hydraulic arrangement of these Figures and similarly in the other Figures, the pressure supplied by pump 30 and built up in the first space 1 as the first pressure, opens the entrance port 17 and presses the piston 6 in cylinder 5 downwards into its bed in the piston shoe 7 and the piston shoe 7 thereby against the outer face 12 of cam ring 9. When the outer face 12 moves away from the cylinder block 16 at one half of the revolution, the cylinder 5 fills up with fluid over inlet port 17. In FIG. 1 inlet port 17 is an inlet valve. At the other half of the revolution the outer face 12 of eccentric cam 10 moves toward the cylinder block 16. Piston shoe 7 then presses the piston 6 into the respective cylinder 5. The FIGS. 1 and 2 show a plurality of cylinders 5 and pistons 6 in cylinder block 16 and an equal number of piston shoes 7 interposed between the outer face 12 and the respective piston 6. At the inwards stroke of the respective piston 6 the entrance port 17 closes and exit port, in this case exit valve, 18, opens. The fluid is pressed out of the respective cylinder 5 by the respective piston 6 over the exit port 18 and enters into the passage 28 wherethrough it flows into the common collection chamber 29. Each exit valve 18 has a connection to a respective passage 28 and each passage 28 in this Figure ends into the common collection chamber 29. From the common collection chamber 29 the fluid is passed through the outlet 21 out of the arrangement in housing 19.

It is very important, that the first pressure in the first space 1 is high enough to open the inlet ports 17 and high enough to press the pistons 6 downward in the inlet stroke and it is still more important, that the first space 1 is sealed and separated from the second space 2. The second space 2 must be empty of pressure or contain a second pressure which must be substantially lower than the mentioned first pressure. Because if there is too high a pressure in the second space 2 which surrounds the cam ring, 10, piston end of piston 6 and the piston shoe 7, the pistons 6 would not move towards the outer face 12 of the cam ring and the device could then not work. The second space 2 is therefore connected by passage 33 over passage 34 to the outside or to a space under substantially low pressure. In FIG. 12 it is shown, that passage 34 of second space 2 may become connected by passage 35 to the inlet 20 of pump 30, which contains suction pressure or other low pressure.

To make the manufacturing of the collection chamber 29 possible, a bush 32 is inserted into housing 19 and it may carry the bearings 22. Bush 32 closes the collection chamber 29 radially inwards. Outlet 21 is communicated to the common collection chamber 29.

In one series of these arrangements which were just completed a few weeks ago, the first pressure was about eight atmospheres, the housing 19 was an aluminium alloy casting, the second pressure was about one atmosphere and the fourth pressure, which is the high pressure supplied out of outlet 21 reached peak pressures of 12,000 (twelve thousand) psi. The overall efficiency was extremely good and the reasons for the good efficiency will become explained at hand of FIG. 15 which shows the preferred embodiments of entrance port, exit port, piston, cylinder block and piston shoe as well as the cylinder in a greater scale for better visibility in the drawing.

Member 24 in FIG. 1 may be provided, when the cylinder block 16 consists of a plurality of individual blocks and plate 25 may serve also in the same way as member or plate 24 to hold separated blocks 16 radially together by common pins in common seats. But plate 25 may in addition facilitate the provision of spring seats for the exit ports or exit valves 18 and it may also serve to make the machining of passages 28 and the connection portions of passages 28 easier.

A part of the bottom portion of FIG. 1 is demonstrated in a larger scale in FIGS. 12 to 14.

FIG. 2 is the section through FIG. 1 along line II—II and shows the location of the plurality of cylinders, pistons and piston shoes respectively and in respect to the cam ring 10. The configuration of the section through cam ring 10 is also shown in FIG. 2.

Unloading recesses, for example 56 are surrounding the hydrostatic bearings which include the fluid pressure pockets 54 and 55. Pockets 54 and 55 may become divided into pluralities of pocket portions to lubricate bearing faces therebetween. The unloading recesses 56 etc. are communicated for example by passages 57 to the second space 2. The upper face and bottom face of piston shoe 7 correspond complementary to the respective end face of piston 6 and outer face 12 of cam 10, 12.

Cylinder block 16 has recesses 47 with guide walls 48 to permit the piston shoe to enter into them. Guide extensions 49 are provided on the piston shoes to be guided along faces or walls 48 of recess 47. Portions 49 remain at all times within recess 47. Recess 47 extends radially outwardly beyond the innermost portion of the cylinder 5 in block 16. The portions 49 of the piston shoe 7 pass temporarily during the piston stroke beyond the inner end of the cylinder 5 deeply into the recess 47. The piston and shoe center themselves under the forces exerted onto them. They are not mechanically connected. The provision of recess 47 and of extensions or portions 49 prevent any escape of the piston shoe 7 out of the recess 47. A long piston stroke is thereby obtained and the proper alignment of piston 6 and shoe 7 is at all times enforced and secured.

The application of the pockets and recesses 54 to 56 requires skill and experience as well as "know how" to obtain the optimum of result. For details the inventor, whose address is visible in the application, may be contacted. The radius of the piston head, which enters into the complementary formed seat in piston shoe 7 depends on the pressure desired and is also a matter of knowledge and experience. The inner diameters of the unloading recesses should only very slightly exceed the diameter of the respective piston 6.

Figure 3:
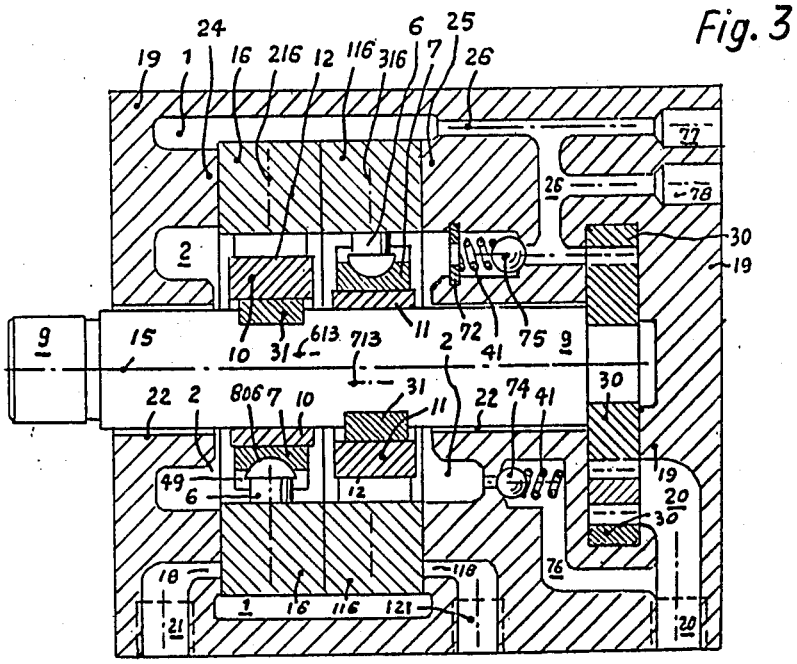
FIG. 3 is a longitudinal sectional view through another embodiment of the invention.

In FIG. 3 the next embodiment of the invention is demonstrated in a longitudinal sectional view. It differs from FIG. 1 mainly therein, that not a single eccentric cam ring 10 is provided, but a plurality of eccentric cam rings 10 and 11. Each of the cam rings is associated to a respective cylinder set 16 or 116. In FIG. 3 the plurality of cylinder blocks 6, 16, 116 is located axially one after the other. The cam rings 10 and 11 are also axially behind each other located. In this embodiment the plurality consists of cylinder blocks 16, 116 with plural individual cylinders each, as in FIG. 1, 2. The number of eccentric cam rings 10, 11 should be equal to the number of cylinder block center faces 216, 316 and the center faces 216, 316 should substantially be equal to the respective medial radial faces of the cam rings 10, 11. The plural cam rings 10, 11 may have different eccentric axes or equal eccentric axes. In the Figure, which has two blocks 16, 11 and 2 cams 10 and 11, the cam 11 is 180 degrees turned angularily relative to cam ring 10. The respective keys 31 show their fastening against rotation on shaft 9. In the Figure cam ring 10 shows the wider portion to the top of FIG. 3 and around eccentric axis 613, while cam ring 11 shows its bigger portion downward and around the eccentric axis 713, whereby the eccentric axes 613 and 713 are located diametrially oppositely respective to the axis 15 of shaft 9. In the case of application of three cam rings they may be turned 120 degrees relative to each other, in case of application of five rings they may be turned 72 degrees relative to each other and so on.

The feature of the arrangement of FIG. 3 is specifically, that plural flows are supplied from the device when so desired and that single flows can be set to act at equal times with equal volumes. This will be explained more in detail in connection with some of the later Figures. Otherwise also this Figure has a first pump 30, in this case an internal gear pump, which suctions fluid through inlet 20 and delivers it into the first space 1 through passage 26.

FIG. 3 also shows, that outlets 77 and/or 78 may be extended from passage 26 through housing 19 in order to permit the exit of fluid of the first pressure out of the arrangement to do work on places external of the housing 19 of the arrangement, when the first pump 30 is sufficiently dimensioned to supply enough first pressure fluid. The members 24 and 25 of FIG. 1 are in this present FIG. 3 integral portions of housing 19 and keep the cylinder blocks 16 and 116 closely fitted between portions 24 and 25. When so desired, a medial plate might become inserted between blocks 16 and 116, but such plate is not drawn in FIG. 3. But it is demonstrated as plate 80 in FIG. 6.

All pistons 6 of both cylinder blocks 16 116 or of the plurality of cylinder blocks may deliver the respective fluid into a common collection chamber 29 as in FIG. 1. But that is not demonstrated in FIG. 3. In FIG. 3 it is however demonstrated, that each cylinder block may deliver into a common collection chamber 18 of the respective cylinder block. But there is still another possibility demonstrated in FIG. 3, namely that each individual piston 6 may deliver into an individual outlet 21, 121 over the respective exit port 18.

While FIG. 1 had exit valves 8 as exit ports, the exit ports 18 in the bottom of FIG. 3 have no exit valves but only simple exit ports which end directly into the respective outlets 21 or 121. It is important however, to not, that these ports 18 are not a must, but that instead the outlet valves 18 of FIG. 1 could be provided in FIG. 3 or 6 if so desired. The piston shoes 7 are shown in simplified sectional views without balancing and unloading recesses in this Figure and the portions of the pistons 6 which extend from the blocks 16, 116 into the second space 2 are shown in outside views in this Figure.

Figure 4:
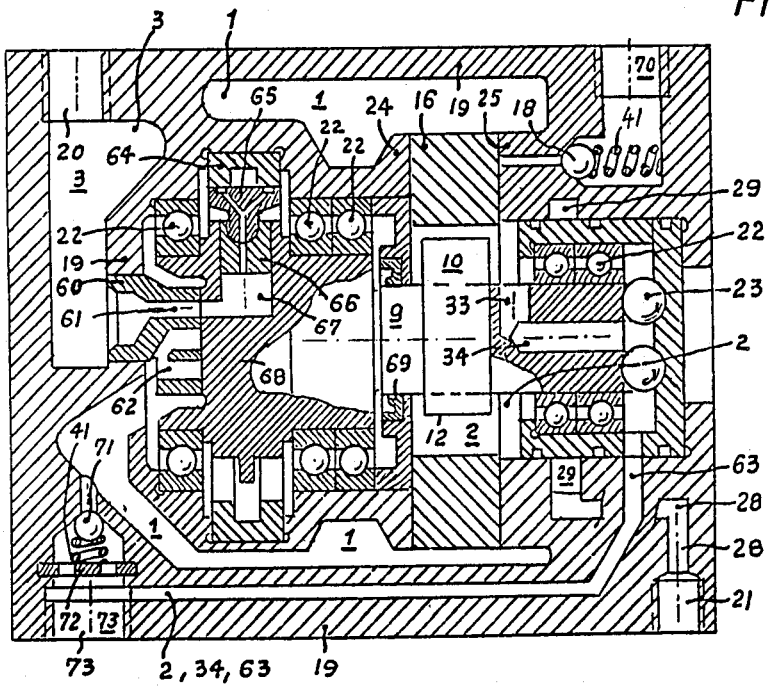
FIG. 4 is a longitudinal sectional view through a further embodiment of the invention.

FIG. 4 will be described later, because FIGS. 6 and 7 to 9 are applicable if so desired in or to FIG. 3. These Figures are therefore discussed now immediately hereafter.

The embodiment of the invention contained in the arrangement of FIG. 4 is commonly utilized as a pressure transmission. Several machines or vehicles, for example ships, aircraft, power shovels, trucks and the like commonly have a basic pressure source or pump of medial or limited higher pressure, for example 3000 to 5000 psi. But at locations remote from the basic pressure source there are occasionally very high pressures desired, for example, 5000 to 15,000 psi. It is then very economical in investment and practice in application to set the pressure transmission of FIG. 4 at the place close to the required high-pressure operation.

Inlet 20 of FIG. 4 is then communicated to the fluid line which carries the basic pressure from the commonly available basic fluid pressure source in the vehicle or machine. The said basic pressure fluid enters the third space 3 in housing 19 as the third pressure. From space 3 the third pressure fluid flows through control body 60 and through control port 61 into the respective cylinders 67 of hydraulic motor 68. Thereby the pistons 66 are moved outward in the cylinders 67 and are running with associated piston shoes along the piston stroke guide 64. Thereby the motor 68 is revolved and supplies the rotary motion and power to shaft 9 to revolve shaft 9 and to drive the cam ring(s) 10, (11) around. When the third pressure fluid flow has set the fluid motor 68 into rotation and maintains the respective time of rotation, the fluid leaves the respective expelling cylinders 67 through the exit passage 62 of control body 60 and flows then into the first space 1.

First space 1 is separated from second space 2 by the seal 69 in housing inner portion 24. And the third space 3 is sealed from the first space 1 by the control body 60 in the respective housing portion of housing 19. The fourth pressure space is the common collection chamber 29 and a fifth space may be one or more single outlets 70. The first space 1 contains the first pressure, which is the outlet pressure of the motor 68, the second space is the low pressure space 2 and contains the second pressure 2 of substantially lower pressure than the first pressure in the first space 1. The first space 1 may have a pressure limitation or overflow valve 71 loaded by spring 41 and held by retainer 72 to let the overflow escape into the second pressure space 2 and its outlet 73.

The rotor 68 of motor 68 may be borne in radial bearings 22 and so may be the shaft 9 which is integral or common to motor 68 and eccentric cam 10. The axial load may be carried by thrustbearing 23. Similar radial bearings 22 may be assembled in the bush 32 which is alread known from FIG. 1. For obtaining a good efficiency, high power at the cost of little wight, it is recommended to use as motor 68 and as control body 60 one or the other of my known U.S. Pat. Nos. 2,975,716; 3,158,103; 3,223,046; 3,277,834, 3,398,696; 3,831,496; 3,850,201; 3,889,577; 3,960,060; 3,951,047; 4,212,230 or others. Cylinder block 16 is contained between housing portions 24 and 25 as known from the already discussed Figures and it contains at least partially the cylinders 5, the pistons 6, the entrance ports 17, the exit ports 18 and the piston shoes 7 are interposed between the respective pistons 6 and the outer face 12 of eccentric cam 10 as also known from the other Figures and as not shown in FIG. 4, because it is already explained at hand of the former Figures. The second space with its substantial lower second pressure communicates through passages 33, 34, 36 with low pressure outlet 73 which may connect to the entrance passage of the basic power source or to the fluid tank of the machine or vehicle.

The highest pressure or fourth pressure is the pressure in the fourth space which is the common collection chamber 29 which is known from the discussion of the earlier discussed Figures. It is in this embodiment connected to a plurality of single exit valves 18 of respective cylinders 6. It supplies the fourth or highest pressure of for example 4000 to 15,000 psi out of outlet 21 via passage 28 as already known from the earlier Figures. If so desired, the outlet pressure may however also be less than 4000 psi. If so desired one or more separated outlets 70 may be provided to single or combined other exit ports or exit valves of other cylinders 5. They may exit a fifth pressure out of the fifth space 70 through outlet 70. An exit valve 18 with spring 41 may be respectively provided in the respective exit passage and outlet 70 or therebetween. The pressure flows supplied out of outlet 21 or out of outlet 70 are effectively capable for highest pressure work at the desired remote place in the vehicle or machine without installation of any other or highest pressure pump or source beside of the device of FIG. 4.

What is claimed is:

1. A hydraulic arrangement, comprising, in combination, a housing, a rotary shaft revolvably borne in said housing, at least one eccenctric cam ring revolving in unison with said shaft when said shaft revolves, surrounding a portion of said shaft and forming a cylindrical outer face of equal radii around an axis which is parallel to the axis of said shaft but distanced therefrom by a first eccentricity; at least one cylinder block provided in said housing and facilitating at least one cylinder, at least one piston, at least one entrance port and at least one exit port to pass fluid into and out of said at least one cylinder when said at least one piston reciprocates in said at least one cylinder; while said housing also includes at least one first space and at least one second space, at least one inlet and at least one outlet; said second space is sealed and separated from said first space; said first space engages said at least one entrance port, said outlet communicates to said at least one exit port; said second space surrounds said at least one cam ring; said at least one piston is capable of partially entering said second space and engaging at least indirectly said outer face of said cam ring, and said outer face of said cam ring at least indirectly engages to guide at least partially the reciprocation - stroke of said at least one piston when said at least one piston reciprocates in said at least one cylinder, wherein said housing includes at least one hydraulic motor, said inlet is communicated to the entrance means of said hydraulic motor, wherein said hydraulic motor rotates said shaft and said eccentric cam ring when fluid is supplied to said motor, wherein said motor has an exit and said exit is provided with an overflow and pressure setting valve whereby the outlet flow of said motor flows under the set pressure of said setting valve into said first space to flow through said entrance port and to drive said piston(s) outward in said cylinder(s), wherein said second space is communicated to a space under substantial low pressure which might be the outlet of said motor after said setting valve, and, wherein said motor drives over said eccentric cam said piston(s) to an inward stroke in said cylinder(s) to supply a flow of fluid of a fourth pressure out of said cylinder(s) and through said outlet out of said arrangement.

* * * * *